US006050674A

United States Patent [19]

Hirabayashi et al.

[11] Patent Number: 6,050,674

[45] Date of Patent: Apr. 18, 2000

[54] MULTI-HEAD PRINTER WITH WIDE PRINTING MODE

[75] Inventors: Hiromitsu Hirabayashi; Akitoshi Yamada, both of Irvine, Calif.

[73] Assignee: Canon Kabushiki Kaisha, Tokyo, Japan

[21] Appl. No.: 08/901,139

[22] Filed: Jul. 28, 1997

[51] Int. Cl.[7] ..... B41J 3/54

[52] U.S. Cl. ..... 347/40; 400/82

[58] Field of Search ..... 347/35, 40, 41, 347/43, 42; 400/61, 82, 76, 279

[56] References Cited

U.S. PATENT DOCUMENTS

| | | | |
|---|---|---|---|
| 4,204,779 | 5/1980 | Lee et al. | 400/144.2 |
| 5,306,102 | 4/1994 | Ota | 400/76 |
| 5,477,246 | 12/1995 | Hirabayashi et al. | 347/12 |
| 5,559,535 | 9/1996 | Otsuka et al. | 347/14 |
| 5,683,188 | 11/1997 | Miyazaki et al. | 347/41 |
| 5,696,542 | 12/1997 | Matsubara et al. | 347/12 |
| 5,708,463 | 1/1998 | Hirabayashi et al. | 347/43 |
| 5,749,662 | 5/1998 | Shibasaki et al. | 400/279 |
| 5,806,997 | 9/1998 | Kawanabe | 400/124.01 |
| 5,821,954 | 10/1998 | Imai et al. | 347/35 |

FOREIGN PATENT DOCUMENTS

| | | |
|---|---|---|
| 331481 | 9/1989 | European Pat. Off. . |
| 724965 | 8/1996 | European Pat. Off. . |
| 822086 | 2/1998 | European Pat. Off. . |
| 822089 | 4/1998 | European Pat. Off. . |

*Primary Examiner*—John Barlow
*Assistant Examiner*—Lamson D. Nguyen
*Attorney, Agent, or Firm*—Fitzpatrick, Cella, Harper & Scinto

[57] ABSTRACT

A multi-head printer, and a driver therefor, in which the multi-head printer has at least a wide width print mode and a standard width print mode. At least first and second print heads are mounted for lateral reciprocal movement across a support surface for a recording medium, with the first and second print heads being laterally displaced with respect to each other such that both the first and second print heads can print a first lateral print area and such that only the second print head can print a portion of a second and larger lateral print area. In the standard width printing mode, fully or partially overlapped printing in the first lateral print area can be effected by both of the first and second print heads. In the wide width print mode, printing by only the second print head is effected, and not by the first print head. An additional wide print mode may be provided for partially overlapped printing by the first and second print heads, with the second print head printing primarily in the second lateral print area. Based on print head configuration, such as the type and color capability of print heads mounted in the first and second print heads, available print modes are determined, from which one of the available print modes is selected for effecting printout by the printer.

59 Claims, 12 Drawing Sheets

| PURGE STATION | FIXED PAPER POSITION | A3 HEAD | FOOTPRINT |
|---|---|---|---|
| L | L | R | SMALL |
| L | R | L or R | LARGER |
| R | L | R or L | LARGER |
| R | R | L | SMALL |

MULTI-HEAD PRINTER WITH WIDE PRINTING MODE

BACKGROUND OF THE INVENTION

1. Field of the Invention

The present invention relates to ink jet or bubble jet printers which have multiple printing heads, and particularly relates to the provision of plural print modes for such printers, including the provision of a wide width print mode and a standard width print mode.

2. Description of the Related Art

Recently-developed ink jet or bubble jet printers (collectively "ink jet printers") are provided with multiple ink jet print heads, such as two or three print heads. The multiple print heads, though mounted on a common carriage, are each capable of independent operation, thereby providing the ability to decrease overall printing time (by overlapped printing by each print head), or to increase overall ink capacity (by providing differently-colored inks in the ink reservoirs for each print head).

FIG. 1 illustrates diagrammatically a conventional ink jet printer having multiple print heads. Shown in FIG. 1 is an ink jet printer 10 having two print heads, namely print head A and print head B. The print heads are mounted for lateral reciprocal movement across a support surface for a recording medium, from the position indicated by solid lines to the position indicated by dotted lines. Print head A can print in area 11, print head B can print in area 12, and both print head A and print head B can print in fully overlapped relation in area 13. These areas all correspond in lateral width to standard A-4 size width or standard 8½×11 inch width. Accordingly, a recording material loaded against paper base position 14, when advanced by printer 10 by unshown feeding means, can be printed upon by print head A, by print head B, or by print heads A and B in a fully overlapped mode.

The inventors of the present application have observed that, as a consequence of lateral and reciprocal movement of print heads A and B so as to be able to print in areas 11, 12 and 13, print head A must be able to scan over area 15, while print head B must be able to scan over area 16. Scan area 16 is larger than the printable area for standard width recording media (i.e., areas 11, 12 and 13). The additional scan width for head B, namely 16*a*, is not printed on and is essentially wasted.

SUMMARY OF THE INVENTION

It is an object of the invention to make use of the wasted scan areas of the print heads, in a variety of different print head configurations.

In one aspect, the invention provides an additional print mode for printing on wide width recording media (such as A-3 or 11×17 inch ledger paper) but with only one print head which, in the example described above, would be print head B. More particularly, in addition to a standard width print mode in which fully or partially overlapped printing by both print heads is performed in a standard width area, the invention provides a wide-width print mode in which printing is performed by only one print head and not the other but over a wider width.

By virtue of the foregoing construction, the invention can provide a wide-width printing capability for printers which heretofore have been limited to a standard width, and can provide the wide width printing capability without significantly increasing the overall footprint of the printer.

Specifically, since multi-head printers are already sized to accommodate the additional scan width of one of the print heads, there is no need to increase the overall size of the printer to additionally accommodate wider format recording media. Thus, the overall footprint of the printer remains substantially the same even though wider format recording media can now be accommodated.

Even greater benefits of the invention can be obtained when different-colored inks are provided in the ink reservoirs for each of print head A and print head B. For example, one conventional multi-head printer provides black ink only for print head B, and cyan, magenta and yellow inks for print head A. Incorporating the invention into such a printer would preserve four color printing in standard widths; whereas for wider format print media, which typically would be accounting ledger sheets for which four color printing is not normally needed, the invention would provide black only print capabilities which were not heretofore obtainable.

According to additional aspects of the invention, sensing means may be provided so as to sense head configuration such as what type of print heads are mounted (for example, black only or three- or four-color print heads), and detection means can be provided so as to detect the width of the recording medium present in the paper path. A controller in the printer automatically selects the most appropriate print mode based on the sensed print head configuration. If desired, it is possible to select mode also based on the detected print media width. Alternatively, the sensed print head configuration and/or the detected print media width can be transmitted over a bi-directional interface back to a host computer from which print data is sent, and the host computer can (1) automatically select the most appropriate print mode based on the data received over the bi-directional interface, or (2) automatically select the most appropriate print mode based on print data characteristics such as color content or page width, or (3) allow a user to select the most appropriate print mode, or (4) permit a combination of any of the foregoing, all based on the available print modes.

Further aspects of the invention comprise a printer driver executable in a host computer so as to output print data to a multi-head printer having a standard width print mode for overlapped printing by two print heads and a wide-width print mode for printing by only one print head and not the others. Based on print head configuration and/or print data characteristics, the print driver determines what print modes are available. The print driver then either automatically selects the most appropriate print mode, or allows a user to select the print mode, whereupon print data is sent to the printer together with the selected print mode so as to effect printout of the print data in the selected mode.

This brief summary has been provided so that the nature of the invention may be understood quickly. A more complete understanding of the invention can be obtained by reference to the following detailed description of the preferred embodiment thereof in connection with the attached drawings.

DETAILED DESCRIPTION OF THE PREFERRED EMBODIMENT

Figure 1:
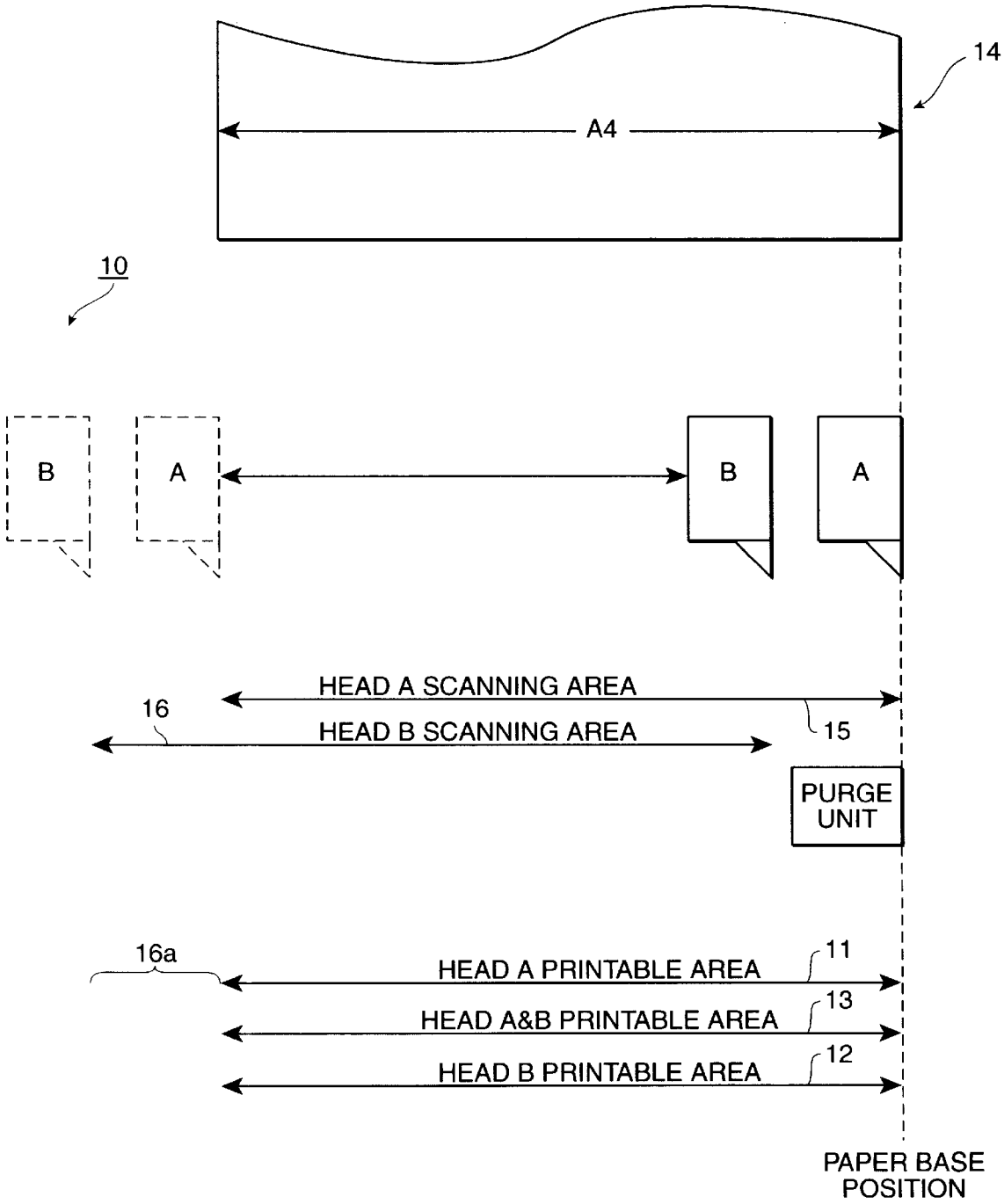
FIG. 1 (Prior Art)
FIG. 1 is a view illustrating the arrangement of print heads in a conventional multi-head printer.
Figure 2:
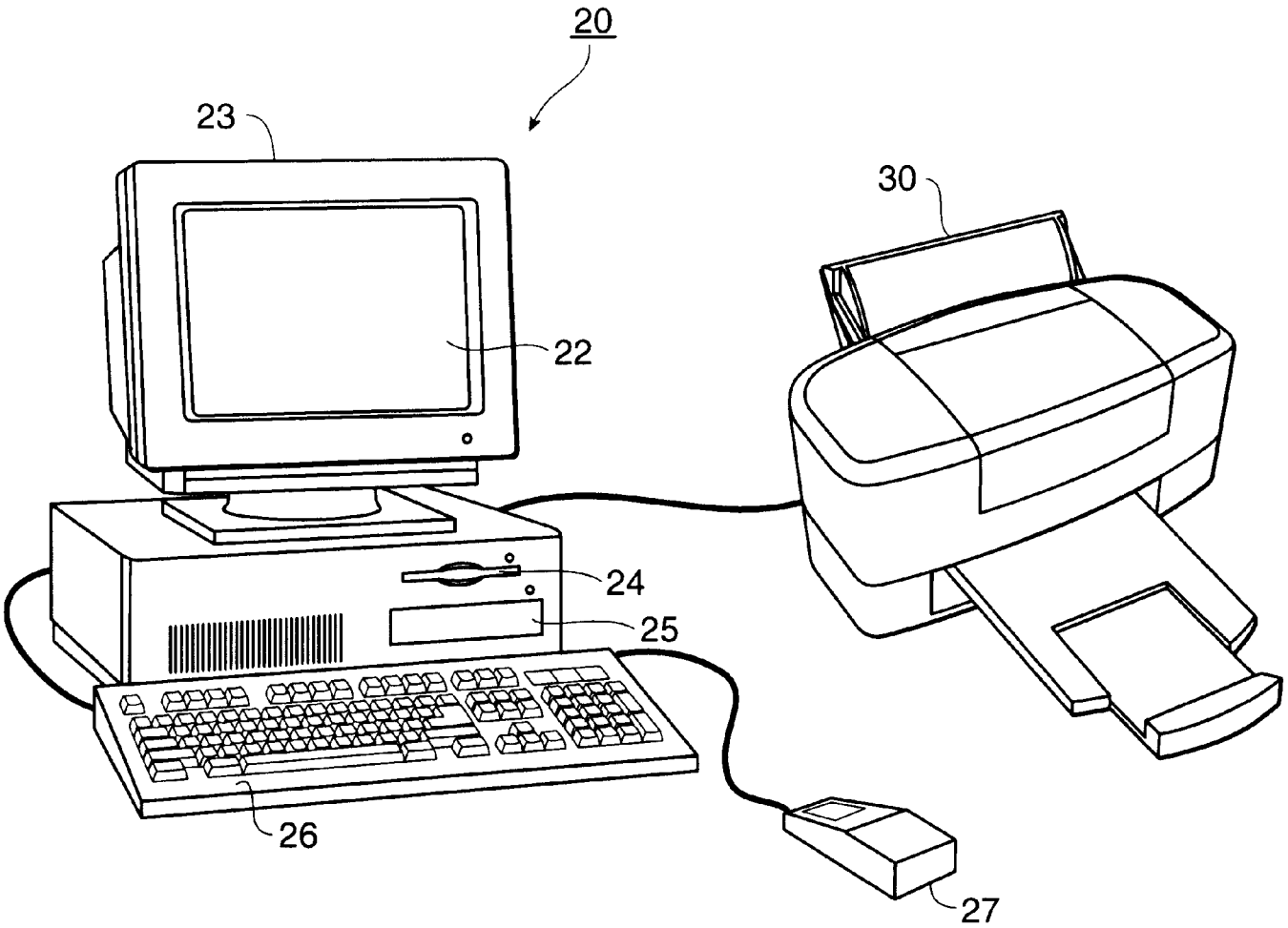
FIG. 2 is a perspective view showing the outward appearance of a representative printer and representative computer equipment according to the invention.

FIG. 2 is a view showing the outward appearance of a representative printer 30 according to the invention, connected to representative computing equipment which incorporates a print driver according to other aspects of the invention Shown in FIG. 2 is computing equipment 20 such as an IBM PC or PC-compatible computer having a windowing operating system such as a Microsoft Windows® operating system. Computing equipment 20 is provided with a display monitor 23 having a display screen 22 on which computing equipment 20 displays images to the user. Computing equipment 20 is further provided with a floppy disk drive 24 with which removable floppy disk media may be read or written, fixed disk drive 25 for storing data files and application program files, a keyboard 26 for permitting input of text data and manipulation of objects displayed on display screen 22, and a pointing device 27 such as a mouse or the like which is also provided to permit manipulation of objects on display screen 22.

Other connections may be provided to computing equipment 20, such as a connection or interface to a local area network or to facsimile/modem/telephone interface, both for sending and receiving color image data as well as other files such as files which include program instruction sequences by which computing equipment 20 is operating.

Printer 30 is a color ink jet printer that includes multiple print heads (here, two print heads) and is interfaced to computing equipment 20. Interface between computing equipment 20 and printer 30 may be of any variety, such as an infrared interface or a standard printer interface, but the interface shown here is an IEEE 1284 bi-directional or Centronix interface. Printer 30 includes a pair of ink jet print heads, with each having plural ink ejection nozzles aligned vertically in groups of each of plural colors, as described more fully below.

In accordance with operator instructions, and under control of the windowing operating system, stored application programs such as graphics application programs, drawing application programs, desktop publishing application programs, and the like, are selectively activated to process and to manipulate data. Also in accordance with operator instructions, and based on those stored application programs, commands are issued to display images on monitor 23 and also to print images appearing on monitor 23 on printer 30.

Figure 3:
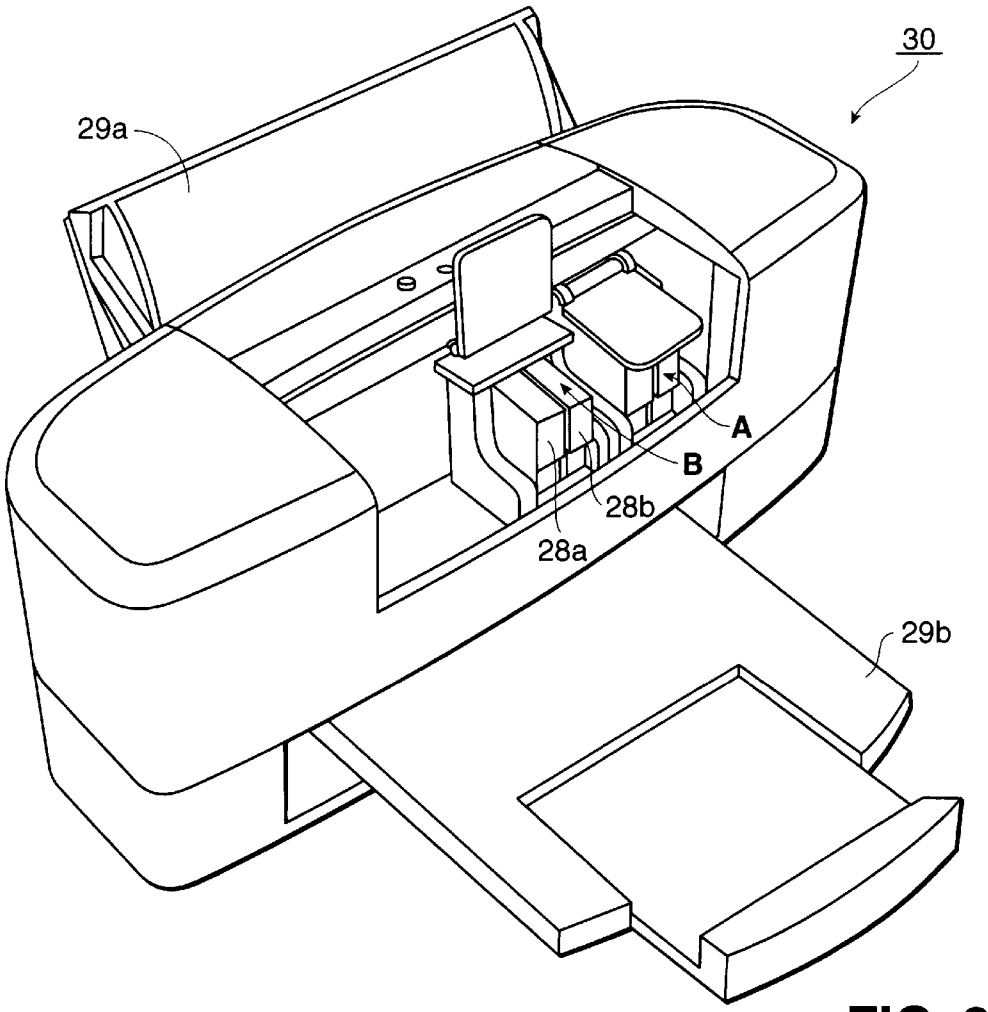
FIG. 3 is a close-up perspective view of a printer according to the invention.

FIG. 3 is a close-up perspective view of printer 30, showing first and second print heads A and B mounted for lateral reciprocal movement in the direction of arrow 1 across an unshown support surface for a recording medium. Each print head carries an ink reservoir to supply ink ejected by print nozzles thereon. In the embodiment of FIG. 3, each print head carries two ink jet reservoirs: a black ink reservoir, and a combined cyan, magenta and yellow (CMY) ink reservoir. In FIG. 3, the two ink reservoirs are respectively depicted at 28*a* and 28*b*, for print head B. It should be understood that the print heads need not be identically configured; rather, as described below, the print heads can be configured differently such as black ink only for print head B and CMY ink only for print head A. Unshown sensing means such as a mechanical key sensor senses the type of print head and ink reservoir color mounted at each position of A and B. The ink reservoirs need not necessarily be carried on their respective print heads; rather, ink can be supplied through flexible tubing from off-head mounted remote ink reservoirs.

In operation, a standard-width recording medium such as paper is fed from supply tray 29*a*, through a feed path past heads A and B for printing thereon, and ejected onto eject tray 29*b*. Wide-width recording media may be fed from supply tray 29*a*, but more preferably wide-width media is fed from a manual feed port (depicted in FIG. 4) in the rear of printer 30. Detection means (also depicted in FIG. 4), such as a light sensor array, detects paper width so as to determine whether the recording medium is, for example, A-4, 8½×11, A-3or 11×17 ledger.

Figure 4:
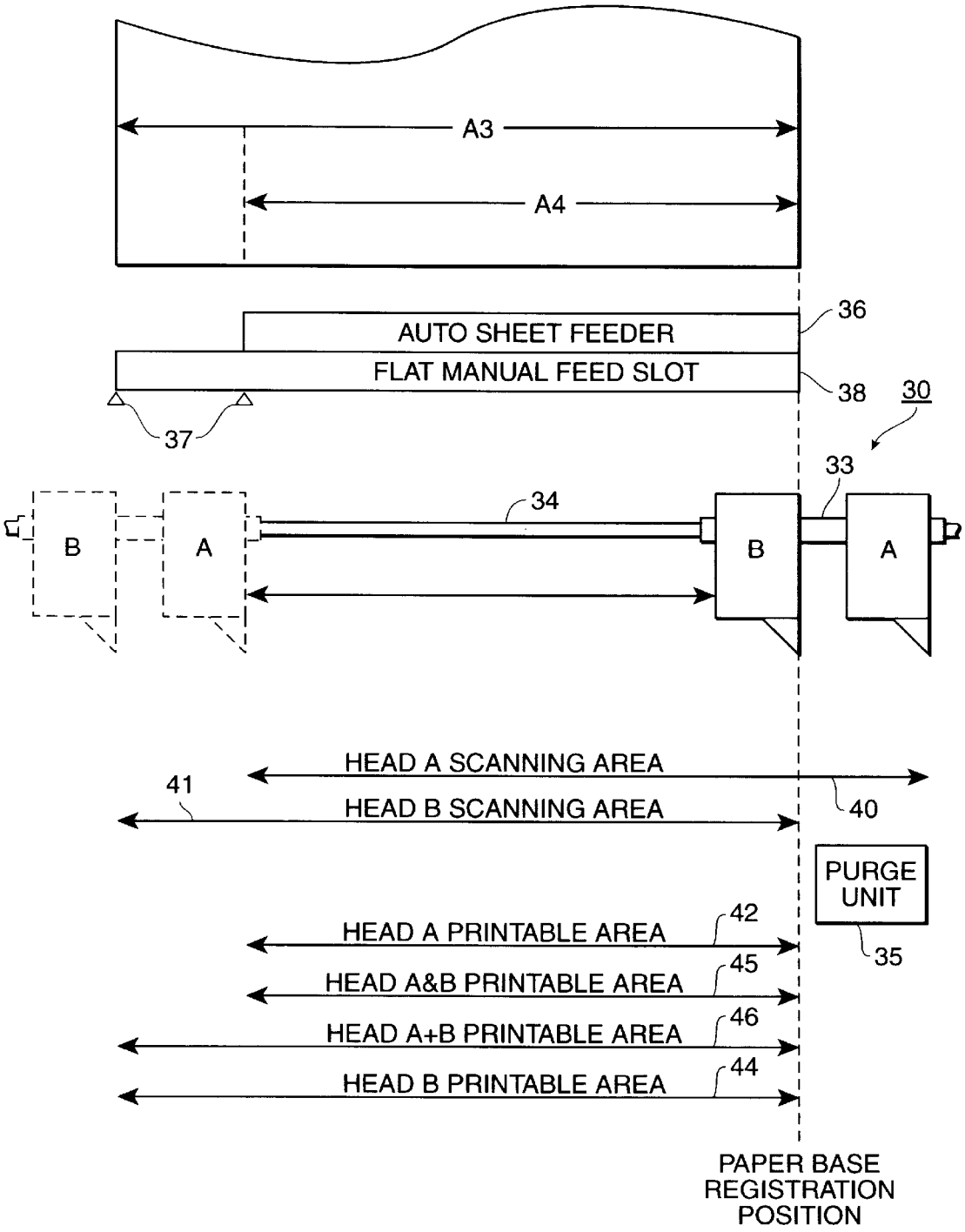
FIG. 4 is a diagram for explaining head configuration of a multi-head printer according to the invention.

FIG. 4 is a schematic view of the arrangement of the dual print heads in printer 30. Each of print heads A and B, each carrying its respective ink reservoir(s), is mounted on carriage 33 for reciprocal back and forth lateral motion on guide rail 34. The carriage 33 is driven across guide rail 34 by suitable driving means, such as a belt or the like, so as to drive print heads A and B in scanning motions across a support surface for the recording medium.

A fixed separation on carriage 33 is provided between print heads A and B. Preferably, the separation is set so as to provide the quickest most efficient printing for the most frequently anticipated use of the printer, while yielding an acceptable printer footprint. For example, if the most frequently anticipated use of the printer were a dual head partially overlapped operation for wide format media (i.e., A3, 297 mm wide), the quickest and most efficient printing would be achieved by setting the separation to one half of the wide width, or ½×297=148.5 mm. This, however, yields an unacceptably large printer footprint. For the printer illustrated in FIG. 3, the most frequently anticipated use of the printer turns out to be partially overlapped printing for standard width media (i.e., A4, 210 mm wide), for which only the central 122 mm (about 5 inches) normally contains printed matter. Under these circumstances, the separation is set to ½×122 mm=61 mm, which yields an acceptably small printer footprint.

A purge unit 35 is provided to purge the nozzles of print heads A and B so as to ensure free flow of ink therethrough. The purge unit is outside of the paper feed path, as defined by fixed paper base registration position 39, against which recording media of all sizes are registered in preparation for printing. The printer includes an automatic sheet feeder 36 to feed sheets of standard width from supply tray 29*a*. A manual feed slot 38 is provided in the rear of printer 30 to accept wide width recording medium, which are too large to be fed from supply tray 29*a* by the auto sheet feeder.

Sensing means 36, such as keyed mechanical interlocks, are provided for each of heads A and B so as to sense the type of head mounted on the carriage, thereby to detect head configuration. Detection means 37, such as LED detection arrays, are provided in a paper feed path of printer 30 so as to detect the width of the recording medium fed therethrough.

With the arrangement shown in FIG. 4, the lateral scanning width of head A is depicted at 40, and the lateral scanning width of head B is depicted at 41. Accordingly, as measured from a paper base registration position 39, against which recording media of all widths are registered, head A printable area is depicted at 42 and head B printable area is depicted at 44. Thus, 45 depicts an area in which both of head A and head B can print in fully or partially overlapped relation with both of head A and head B being able to print throughout the entire region, and 46 depicts an area in which head A and head B can print in partially overlapped relation with a part of the area (the left-most part) being printed exclusively by head B and with another part (the right-most part) being printed exclusively by head A. Preferably, area 45 corresponds to a width of A-4 recording medium, (that is, 210 mm), while area 46 corresponds to a width of A-3 recording medium (that is, 297 mm).

Figure 5:
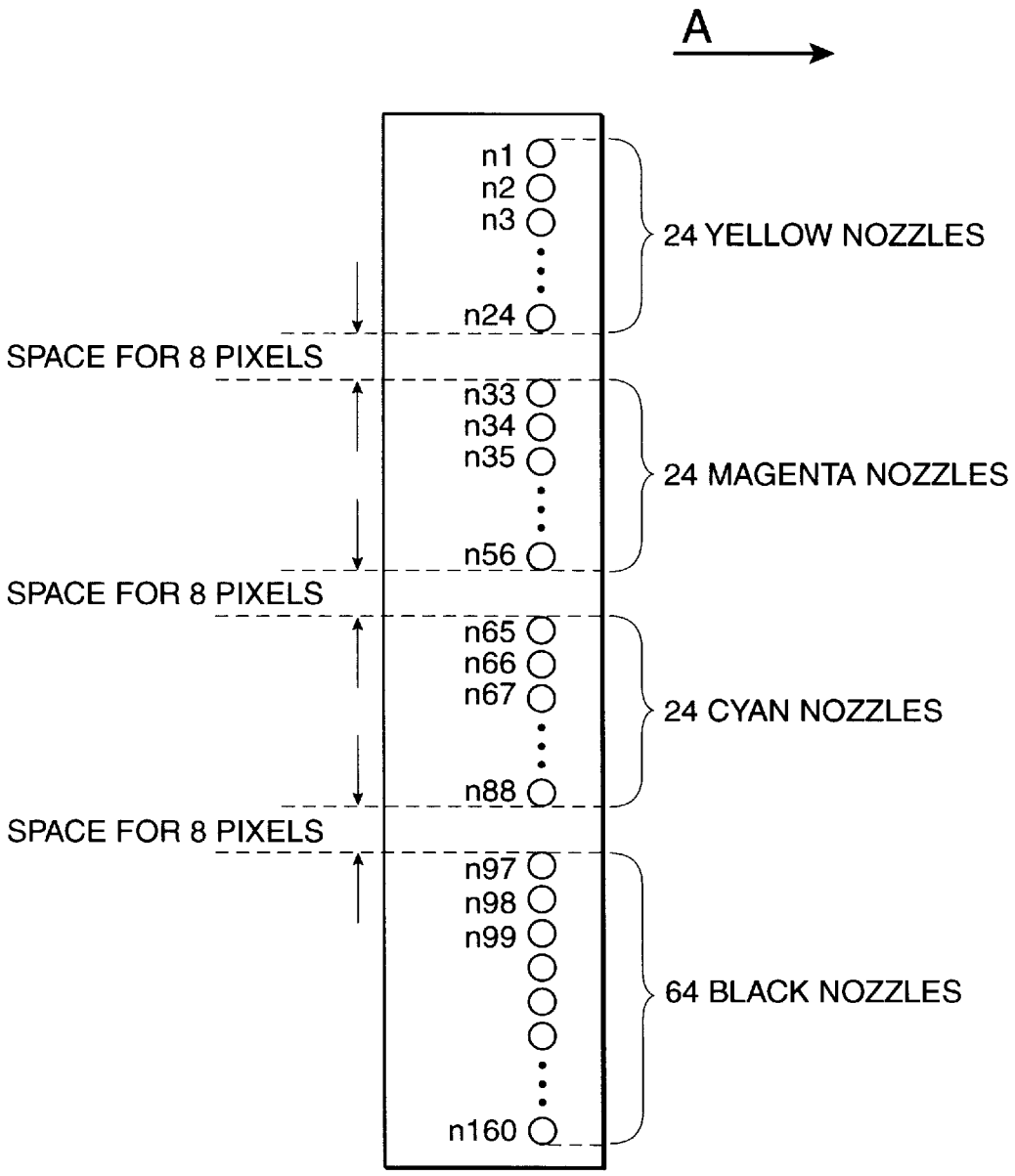
FIG. 5 is a view showing print element (or nozzle) arrangement in a print head.

FIG. 5 shows the arrangement of print elements on each of print heads A and B. As shown in FIG. 5, the print elements are vertically oriented and arranged in groups for each ink color, with 24 nozzles being provided for yellow ink, 24nozzles being provided for magenta ink, 24 nozzles being provided for cyan ink, and 64 nozzles being provided for black ink. As seen in FIG. 5, the print elements are arranged vertically, or near-vertically with a slight slant angle that corresponds to formation of a vertical line during rapid sequential firing of the nozzles during movement of the print head in the direction of arrow A. The print head is driven horizontally across the recording medium so as to effect printing in bands, with one band corresponding to the 24 rows of pixels printed during one scan of the print head.

Figure 11:
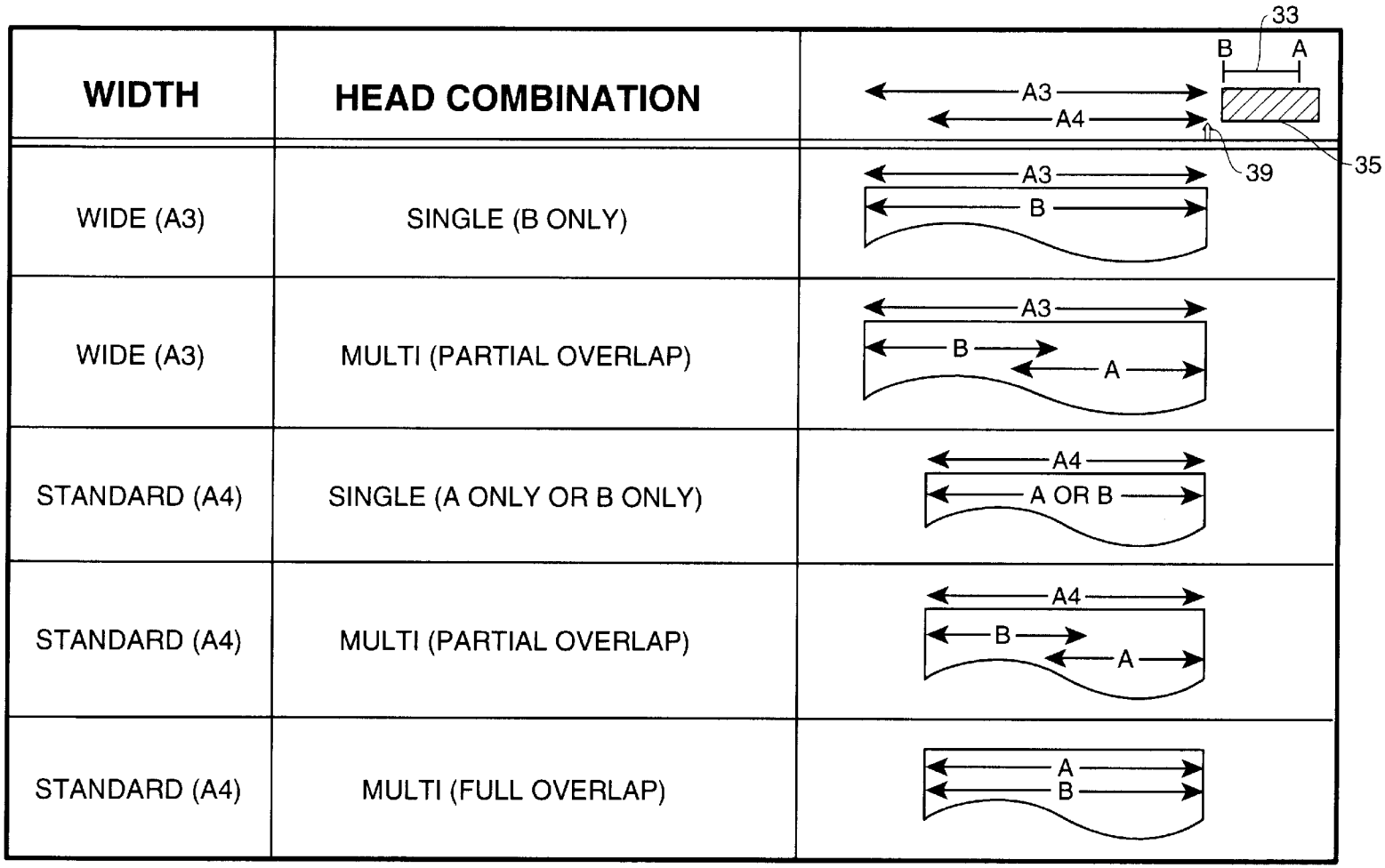
FIG. 11 is a view for explaining head combinations usable for printing in a printer according to the invention.

FIG. 11 depicts the head combination usable for printing. The upper right corner of FIG. 11 schematically depicts the arrangement of printer 30, and shows the relative position of print heads A and B, carriage 33, purge unit 35, and fixed paper registration position 39. As shown in the remainder of FIG. 11, for wide width recording media, single head printouts (by head B only) or partially overlapped multi-head printouts are available. For standard width recording media, single head printouts (using either head A or head B), or partially- or fully-overlapped multi-head printouts are available. These head combinations, when coupled with particular head configurations, determine the available print modes, as described below.

Figure 6:
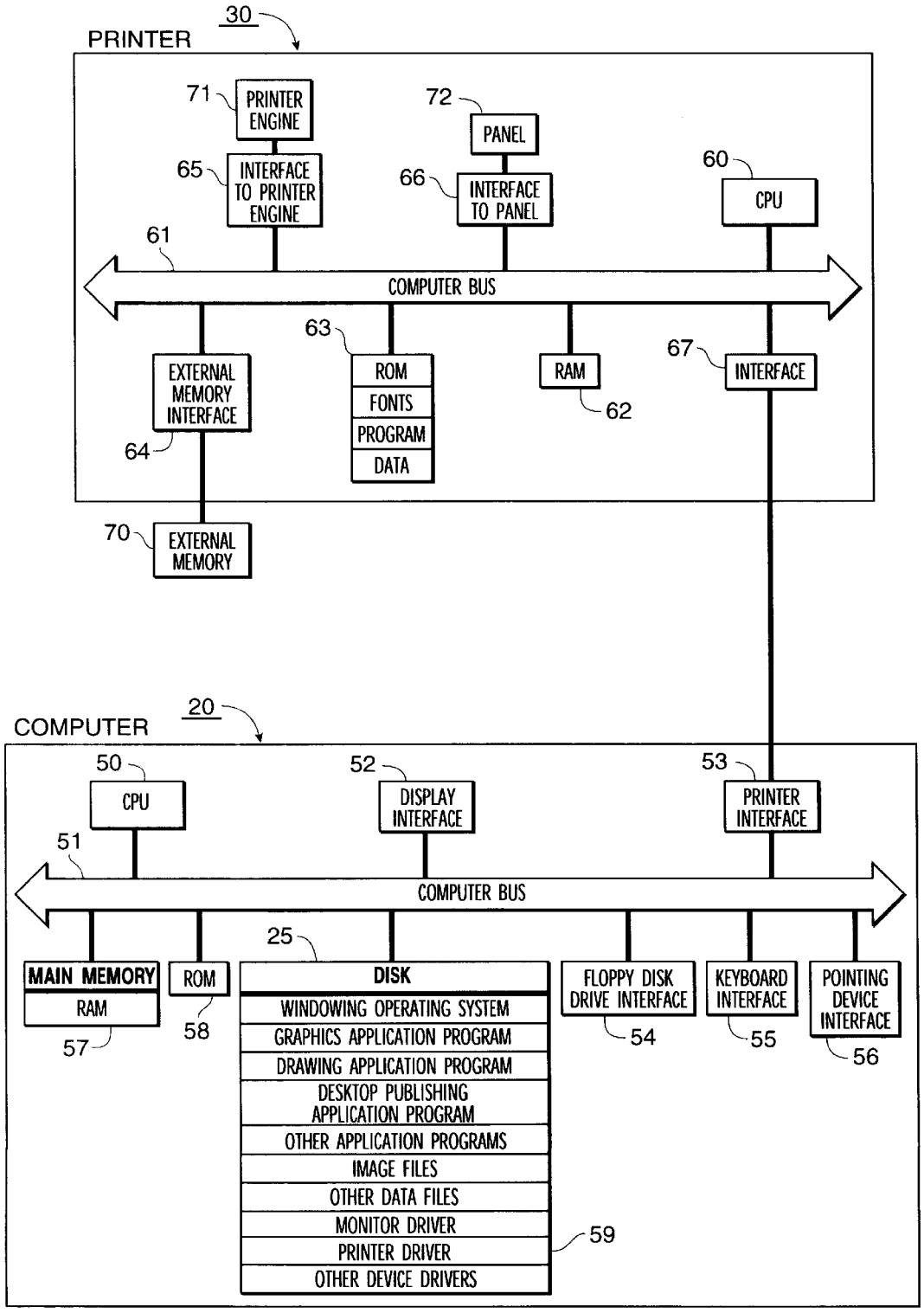
FIG. 6 is a detailed block diagram showing the internal construction of the computing equipment and the printer shown in FIG. 2.

FIG. 6 is a detailed block diagram showing the internal construction of computing equipment 20 and the internal construction of printer 30. As shown in FIG. 6, computing equipment 20 includes a central processing unit (CPU) 50 such as a programmable microprocessor interfaced to computer bus 51. Also interfaced to computer bus 51 is a display interface 52 for interfacing to display 23, a printer interface 53 for interfacing to printer 30, a floppy disk drive interface 54 for interfacing to floppy disk 24, a keyboard interface 55 for interfacing to keyboard 26, and a pointing device 56 interface for interfacing to pointing device 27.

Main memory 57 such as random access memory (RAM) interfaces to computer bus 51 so as to provide CPU 50 with access to memory storage. In particular, when executing stored application program instruction sequences such as those associated with application programs stored on disk 25, CPU 50 loads those application instruction sequences from disk 25 (or other storage media such as media accessed via a network or a floppy disk drive 24) into main memory 57 and executes those stored program instruction sequences out of the main memory.

Read only memory (ROM) 58 is provided for storing invariant instruction sequences, such as start-up instruction sequences or basic input/output operating system (BIOS) sequences for operation of keyboard 26.

As shown in FIG. 6, and as previously mentioned, fixed disk 25 stores program instruction sequences for the windowing operating system and for various application programs such as graphics application programs, drawing application programs, desktop publishing application programs, and the like. In addition, fixed disk 25 also stores color image files such as might be displayed on monitor 23 or printed on printer 30 under control of a designated application program. Fixed disk 25 also stores a color monitor driver which controls how RGB color primary values are provided to display interface 52, and a print driver 59 which is a print driver for controlling how CMYK color component values are derived from RGB color primary values and provided to printer interface 53 together with a print mode selected in accordance with the invention, for print out by printer 30.

Other device drivers are also stored on fixed disk 25, for providing appropriate signals to various devices, such as network devices, facsimile devices, and the like, connected in computing equipment 20.

Ordinarily, application programs and drivers stored on disk 25 need first to be installed by the user onto disk 25 from other computer readable media on which those programs and drivers are initially stored. For example, it is customary for a user to purchase a floppy disk or other computer readable media such as CD-ROM on which a copy of a printer driver according to the invention is stored. The user would then install the printer driver 59 onto floppy disk 25 through well-known techniques by which the printer driver is copied into disk 25. At the same time, it is also possible for the user, via an unshown modem interface or via an unshown network, to download a printer driver according to the invention, such as by downloading from a file server or from a computerized bulletin board.

Reverting to FIG. 6, printer 30 includes a CPU 60, such as a V853 single chip microprocessor, connected to computer bus 61. Also connected to computer bus 61 are RAM 62, ROM 63, external memory interface 64, interface 65 to a print engine, interface 66 to a panel, and interface 67 to computer 20. RAM 62 is comprised of working storage for printer 30, and in particular includes a print data buffer area as described more fully below. ROM 63 is comprised by a font ROM for storing font data, a program ROM to store program instruction sequences used to control printer 30, and invariant data such as printer model number and the like. External memory interface 64 interfaces to external memory cartridges such as cartridge 70 that provide additional fonts for printer 30, or provide additional random access memory. Interface 65 interfaces to a print engine 71 including interfaces to printer heads A and B, an interface to the drive means for carriage 33, an interface to purge unit 35, and other unshown interfaces such as interfaces to document feed sections and interfaces to printer nozzle controls. Interface 66 to a panel includes an interface to panel 72, comprised, for example, by an LCD display for displaying status of the printer, LEDs for indicating on-line and off-line or error conditions, and various control buttons for setting and otherwise interfacing with printer 30. Interface 67 includes a complementary interface to printer interface 53 of computer 20.

Together, CPU 60, bus 61, RAM 63 and ROM 63 comprise control means for controlling operation of printer 30.

Although FIG. 6 illustrates the individual components of printer 30 as separate and distinct from one another, it is preferable that at least some of those components are combined. For example, it is preferable to combine external memory interface 64, interface 65 to the print engine, interface 66 to the panel, and interface 67, all into a single gate array. Most preferably, the aforementioned gate array is further combined with CPU 60, RAM 62 and ROM 63 into a so-called four-in-one chip, which eliminates the need to provide leads to a separate computer bus and lessens the number of interconnections needed so as to fabricate a control portion for printer 30.

Figure 10:
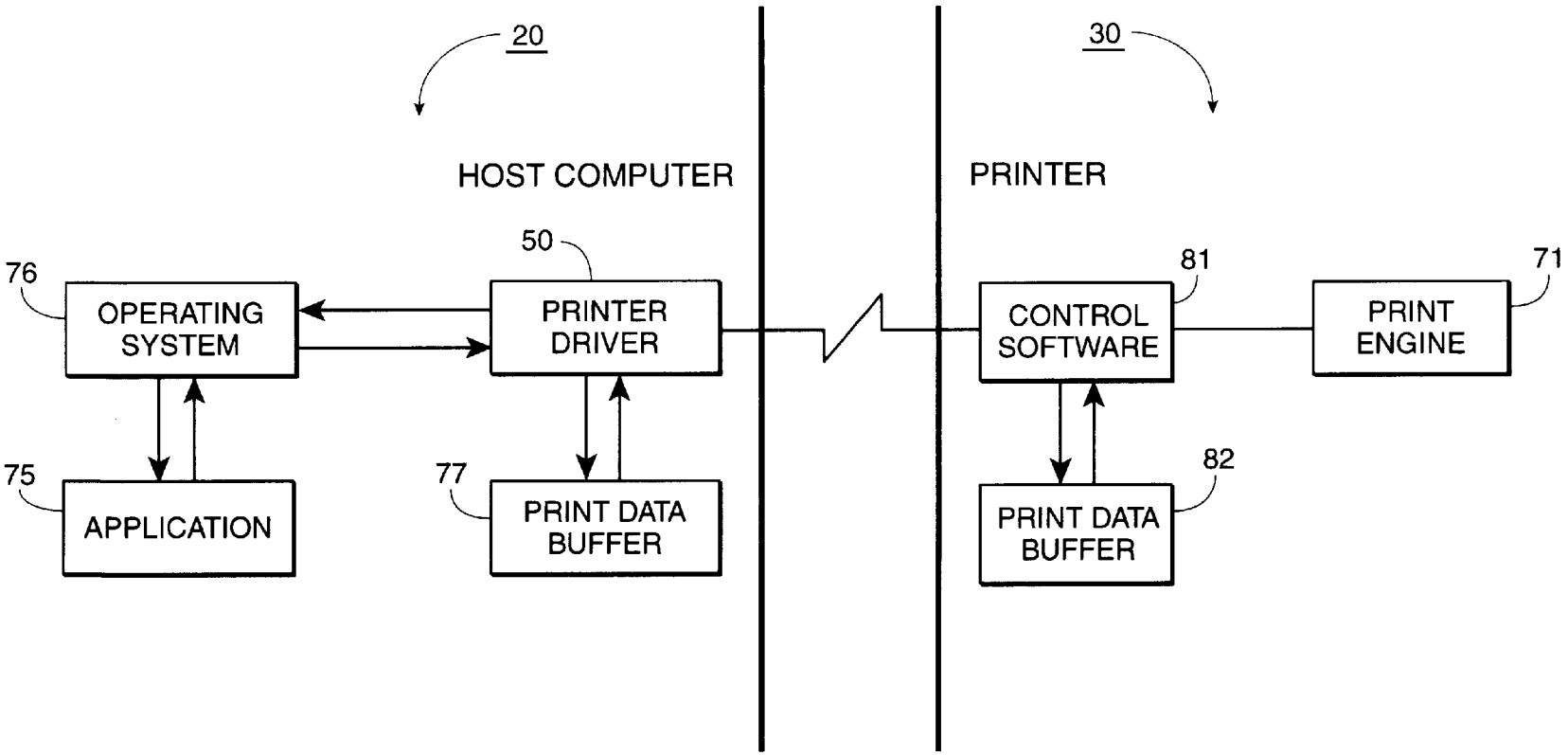
FIG. 10 is a high-level functional block diagram of the interaction between the host computer and the printer.

FIG. 10 is a high-level functional block diagram illustrating how computer 20 interacts with printer 30 in the practice of the invention. As shown in FIG. 10, in response to a printing instruction issued from application program 75, such as an image processing application stored on disk 25, the windowing operating system 76 issues graphics device interface calls to printer driver 50. In accordance with the invention, printer driver 50 selects a print mode and derives print data corresponding to the print instruction from application 75, and stores the print data in print data buffer 77. Thereafter, and again in accordance with the invention, print driver 50 obtains print data from print data buffer 77 and transmits the print data to printer 30 for printout thereby.

At the receiving end, printer 30 through use of control software 81 comprised by the program stored in ROM 63 receives the print data from print driver 50 and stores it in a print data buffer 82. Print data buffer 82 resides in RAM 62. Thereafter, control software 81 retrieves the stored print data from print data buffer 82, processes it such as by decompression, and transmits it to print engine 71 for printout thereby.

Figure 7:
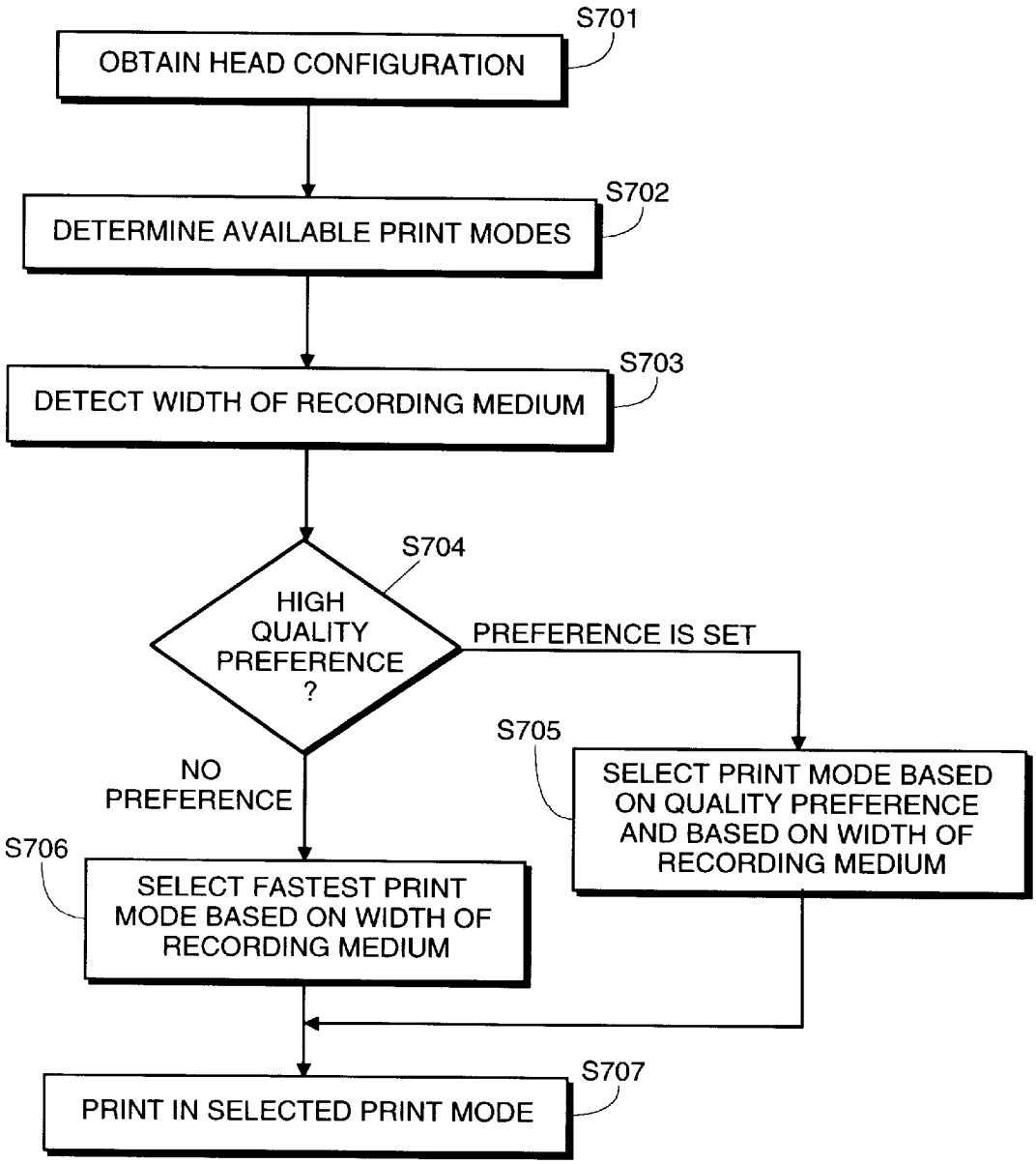
FIG. 7 is a flow diagram for explaining print mode selection in the printer.

FIG. 7 is a flow diagram showing process steps by which the control means of printer 30 selects a print mode for operation in accordance with the invention. The process steps shown in FIG. 7 are stored as code on a computer-readable medium such as ROM 63 for execution by CPU 60 in printer 30.

Generally speaking, the process steps shown in FIG. 7 provide for selection of a print mode in accordance with head configuration on printer 30. If desired, print mode selection might also be based on a detected width of the recording medium or on whether or not a preference has been set as to print quality. With respect to print quality, it should be borne in mind that print quality will generally be higher when printing is performed with only a single head, since printing with a single head will ensure that print quality is not adversely affected by possible misalignments or other mismatches such as a density mismatch between each of multiple print heads. Thus, for example, if the nozzles on print head A are vertically misaligned with respect to corresponding nozzles on print head B, print output performed by print head A will likewise be misaligned with respect to print output formed by print head B. Application No. 08/901,560, "Auto-Alignment System For A Printing Device", filed by the inventors herein, describes how to detect and compensate for such a misalignment, but in general it is difficult to compensate for misalignment better than ±½ a print element. Such a misalignment will appear as a vertical step in the printed output, and will be avoided altogether if printing is confined to printing by only a single print head.

Referring to FIG. 7, step S701 obtains head configuration through readout of sensing means 36. In particular, step S701 reads sensing means 36 so as to determine what type of print head is mounted at each of print positions A and B. For example, it is possible that each of the print positions may have mounted therein an all-black print cartridge, a three-color (CMY) print cartridge, a four-color (CMYK) print cartridge, or a photo print cartridge. (A photo print cartridge refers to a print cartridge having inks of lesser density than normal, so as to provide additional inks to select from and to produce more photo-realistic printed output.) In addition, it is possible that no print cartridge at all is mounted at a particular print station, or the print cartridge mounted at a particular print station is not functioning properly such as through an out-of-ink condition or other malfunction. Whatever the print head configuration, it is obtained in step S701 whereafter flow advances to step S702 for a determination of the available print modes.

Specifically, step S702 determines the available print modes based on the printer head configuration. The phrase "available print modes" refers to the print modes that are possible based on the print head configuration and based on the head combinations shown in FIG. 11. For example, if printer head A is a three-color print head and printer head B is a black-only print head, then available print modes include standard width single-or multi-head black-and-white printout, standard width multi-head color printout, and wide width single head black-and-white printout; whereas if head A is replaced with a four-color print head then the available print modes in addition include a wide width multi-head black-and-white printout. Available print modes based on some typical head configurations for each of heads B and A are shown in the following Table 1.

| HEAD CONFIGURATION | | |
|---|---|---|
| HEAD B | HEAD A | AVAILABLE MODES |
| BLACK | NOT AVAILABLE | Wide-Width Single Head B/W<br>Standard-Width Single Head B/W |
| BLACK | BLACK | Wide-Width Single Head B/W<br>Wide-Width Multi-head B/W<br>Standard-Width Single Head B/W<br>Standard-Width Multi-head B/W |
| BLACK | 3-COLOR | Wide-Width Single Head B/W<br>Standard-Width Single Head B/W<br>Standard-Width Multi-head Color |
| BLACK | 4-COLOR | Wide-Width Single Head B/W<br>Wide-Width Multi-head B/W<br>Standard-Width Single Head B/W<br>Standard-Width Multi-head B/W<br>Standard-Width Single Head Color |
| 4-COLOR | NOT AVAILABLE | Wide-Width Single Head B/W<br>Wide-Width Singe Head Color<br>Standard-Width Single Head B/W<br>Standard-Width Single Head Color |
| 4-COLOR | BLACK | Wide-Width Single Head B/W<br>Wide-Width Multi-head B/W<br>Wide-Width Single Head Color<br>Standard-Width Single Head B/W<br>Standard-Width Multi-head B/W<br>Standard-Width Single Head Color |
| 4-COLOR | 3-COLOR | Wide-Width Single Head B/W<br>Wide-Width Single Head Color<br>Standard-Width Single Head B/W<br>Standard-Width Single Head Color<br>Standard-Width Multi-head Color |
| 4-COLOR | 4-COLOR | Wide-Width Single Head B/W<br>Wide-Width Multi-head B/W<br>Wide-Width Single Head Color<br>Standard-Width Single Head B/W<br>Standard-Width Multi-head B/W<br>Standard-Width Single Head Color<br>Standard-Width Multi-head Color |

-continued

| HEAD CONFIGURATION | | |
|---|---|---|
| HEAD B | HEAD A | AVAILABLE MODES |
| 4-COLOR | PHOTO | Wide-Width Single Head B/W<br>Wide-Width Single Head Color<br>Standard-Width Single Head B/W<br>Standard-Width Single Head Color<br>Standard-Width Multi-head Photo |
| NOT AVAILABLE | BLACK | Standard-Width Single Head B/W |
| NOT AVAILABLE | 4-COLOR | Standard-Width Single Head B/W<br>Standard-Width Single Head Color |

Flow advances to steps S703 through S706 in which one print mode from the available print modes is automatically selected by the control means. Selection may be based on detected width of the recording medium, or it may be based on whether or not a preference has been set as to print quality, or both. If selection based on detected medium width is desired, then step S703 detects the width of the recording medium by reference to detection means 37. Flow then advances to step S704 which determines whether a print quality preference has been set by the user. Typically, a print quality preference may be set by a manually-operable switch on the face of printer 30, or may be set by interaction of the user with the control panel of the printer. Print quality preference can include a choice from among "HIGH", "FAST", or "AUTO SELECT". Based on whether a print quality preference has been set, flow advances either to step S705 or to step S706.

If a print quality preference has been set, then step S705 selects a print mode from the available print modes based on the print quality preference. On the other hand, if no print quality preference has been set, then flow advances to step S706 in which the fastest print mode is selected based on the print modes available for the detected width of the recording medium. In either event, flow then advances to step S707 in which printer 30 prints in the selected print mode.

Figure 8:
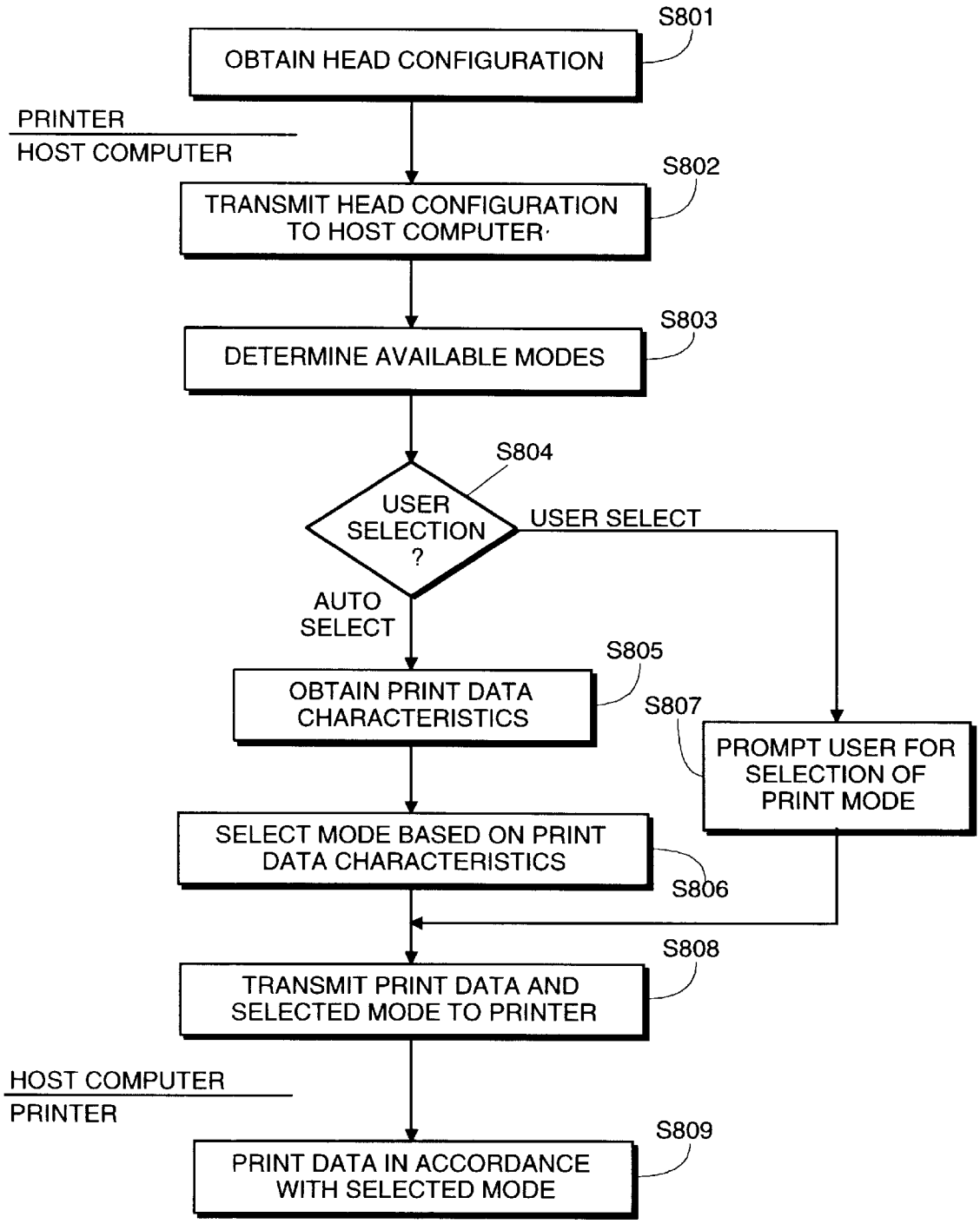
FIG. 8 is a flow diagram for explaining a print driver and print mode selection therein.

FIG. 8 is a flow diagram showing process steps for a printer driver in accordance with the invention. Process steps S803 through S808 are stored as code on a computer-readable medium for execution by CPU 50 in host computer 20, such as being stored in disk 25.

Generally speaking, the process step shown in FIG. 8 are a printer driver executable in a host computer so as to set a printer mode for printout of a print image by an ink jet printer having multiple print heads laterally spaced apart with respect to each other. The printer includes plural print modes including at least a standard width print mode for overlapped printout in a first lateral print area by both of first and second print heads, as well as a wide width print mode for printout in a second and larger lateral print area by only one print head and not any others. The process steps determine available print modes based on printer head configuration, and automatically select a print mode from the available print modes based on print data characteristics such as color content and desired print width. Alternatively, the available print modes may be displayed for user selection of one of the available print modes. Print data and the selected mode are thereafter transmitted to the printer for printout thereby.

In more detail, in step S801 the printer 30 obtains print head configuration in a manner similar to that in step S701, and in step S802 printer 30 transmits the head configuration over the bi-directional interface to host computer 20. In step S803, host computer 20 determines the available print modes. Processing for step S803 is identical to that of step S702, with the exception that processing is performed in host computer 20 rather than in printer 30.

Flow then advances to step S804 in which host computer 20 determines whether to prompt a user to select a print mode from the available print modes, or whether to automatically select a print mode based on print data characteristics. If automatic selection is desired, then flow advances to step S805 in which host computer 20 examines the characteristics of the print data. Specifically, characteristics of the print data includes color content of the print data, as well as desired width of printout of the print data. The phrase "color content" refers, for example, to whether the print data is black-and-white print data, full-color print data, or photo-quality print data. Based on the print data characteristics, step S806 selects one of the available print modes for use by the printer. Flow then advances to step S808 in which host computer 20 transmits the print data and the selected mode to printer 30, whereupon printer 30 prints the data in accordance with the selected mode (step S809).

Figure 9:
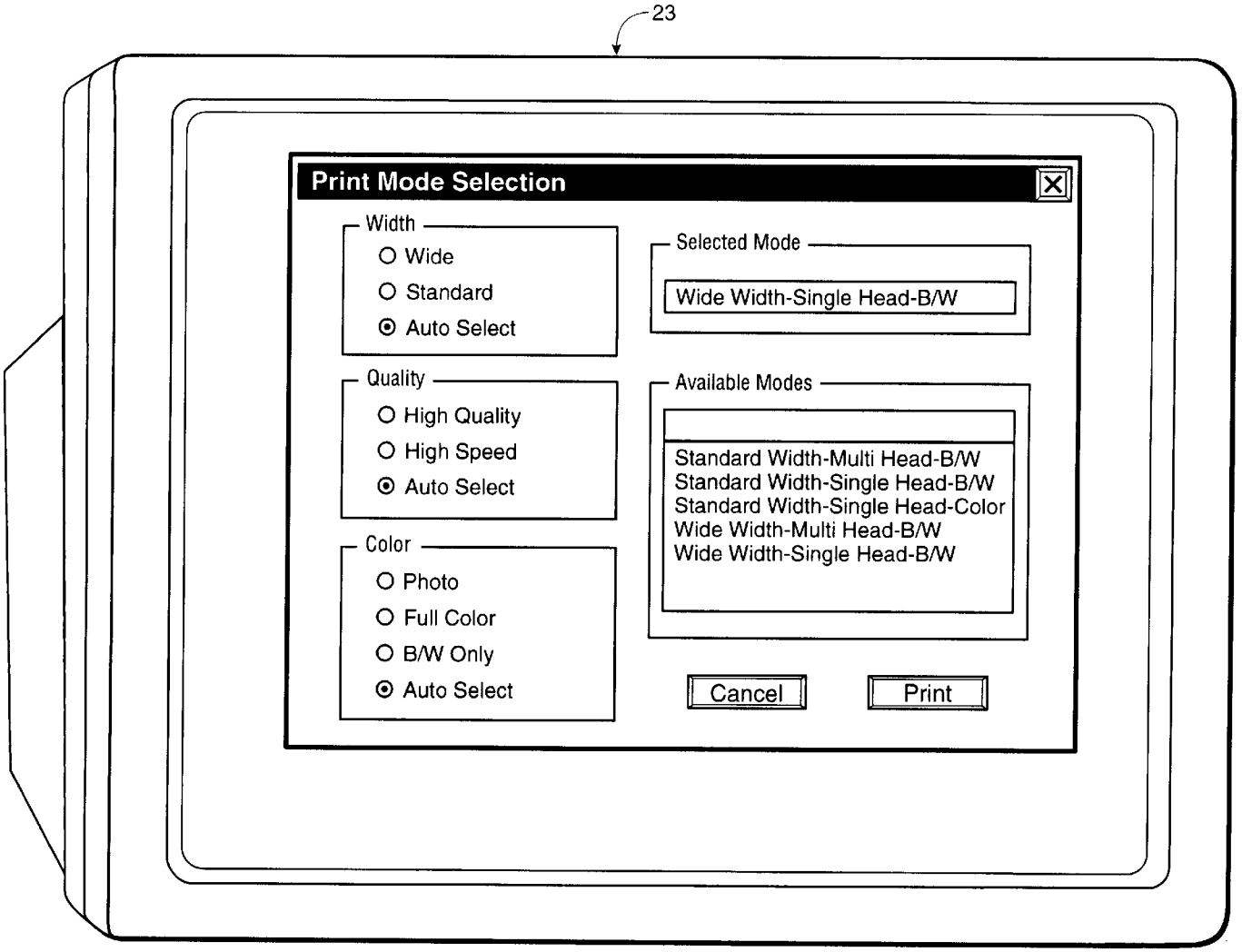
FIG. 9 is a representative example of a prompt for user selection of printing mode.

On the other hand, if in step S804 user selection is desired, then flow branches to step S807 in which the user is prompted to select a print mode from the available print modes. FIG. 9 shows a suitable graphical user interface by which a user is prompted to select a display mode from the available display modes. As seen in FIG. 9, all available print modes are displayed for selection by the user, and in addition, the user is presented with a variety of options as to print width, quality, and color. If "AUTO SELECT" is selected for each of these options, then the user is presented with the widest variety of available print modes. On the other hand, by selecting a specific width, quality or color content, the user may narrow his choices of available print modes, thereby to assist him in selecting the most appropriate print mode for desired print output. When the user is satisfied with his choice, the "PRINT" button is selected, thereby verifying his selection to host computer 20.

Upon receiving the user's selection of available print modes, flow returns to steps S808 and S809 whereby print data and the selected print mode are transmitted to the printer for print out thereby.

Figure 12:
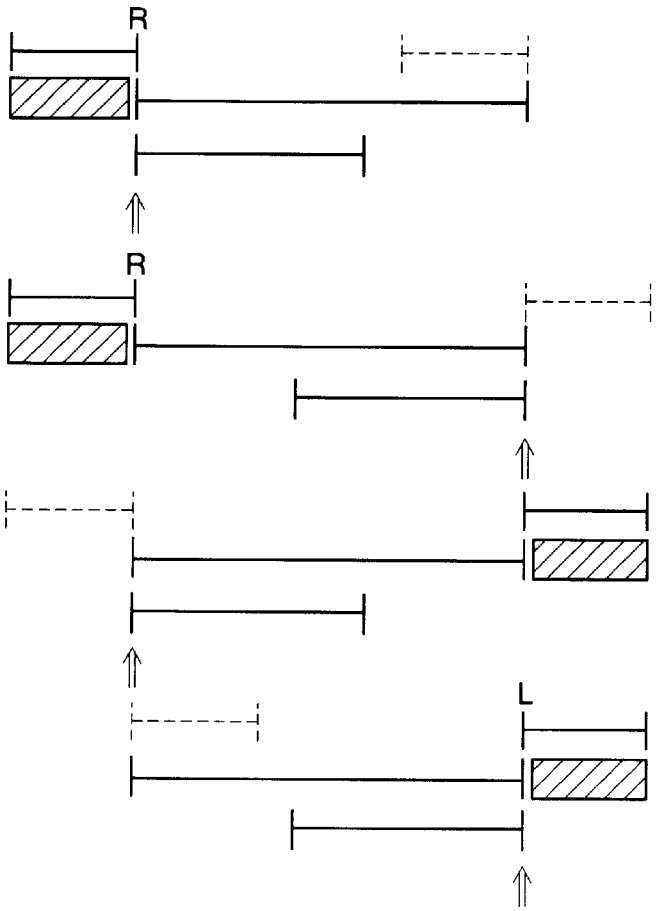
FIG. 12 is a view for explaining how printer footprint is affected by relative placement of the fixed paper registration position and the print head purge/maintenance station.

As described above in connection with FIG. 4, printer footprint is affected by head separation between heads A and B. FIG. 12 depicts how printer footprint is additionally affected by the relative placement of fixed paper registration guide 39 and print head purge station 35. That is, FIG. 12 depicts four possible combinations of positions for registration guide 39 and purge station 35: left/left, left/right, right/left and right/right. For each combination, the home position of carriage 33 and heads A and B is depicted in solid lines, whereas the far scanned position of the carriage and heads is depicted in dotted lines. ("Far scanned position" means the position to which the carriage and heads must travel so as to ensure that fully overlapped printing is possible for standard width recording media.) The lowermost combination (i.e., right/right) is the same as the combination depicted in FIG. 4. With this combination, the wide mode (A3) head is the left head on carriage 33, and the far-scanned position is shown in dotted lines. The overall effect is a printer with a small footprint.

Likewise, for the topmost combination (i.e., left/left), the wide mode head is the right head, and the far-scanned position is depicted in dotted lines. Again, the overall footprint is small.

However, for the left/right combination, in which the wide mode print head may be either the left head or the right head, the far-scanned position is depicted in dotted lines. The overall footprint is larger. A similar larger footprint is obtained for the right/left combination. It can therefore be observed that the overall printer footprint is small if the purge station 35 and the fixed paper registration guide 39 are positioned on the same side of the printer, with the purge station located outside of the paper feed path. In addition, for uniformity of printing, it is further preferable for the wide mode print head to be opposite to the fixed paper position.

It is emphasized that several changes may be applied to the above-described system without departing from the teaching of the invention. In particular, it is intended that all matter contained in the present disclosure, or shown in the accompanying drawings, shall be interpreted as illustrative and not as limiting. Rather, the scope of the invention is meant to be determined based on the appended claims.

What is claimed is:

1. A multi-head printer having wide width and standard width printing modes, comprising:

at least first and second print heads mounted for lateral reciprocal movement across a support surface for a recording medium, said first and second print heads being laterally displaced with respect to each other such that a first lateral print area is printable by both of said first and second print heads and such that a portion of a second and larger lateral print area is printable by said second print head but not by said first print head;

a standard width print mode for overlapped printing in the first lateral print area by both of said first and second print heads; and a wide width print mode for printing on a wide width print medium in the second lateral print area by at least said second print head and not by said first print head.

2. A multi-head printer according to claim 1, wherein said heads are laterally displaced by a distance corresponding approximately to one half of the width of standard width printed matter.

3. A multi-head printer according to claim 2, wherein said first and second print heads are displaced by approximately 61 mm.

4. A multi-head printer according to claim 1, further comprising a wide print multi-head mode for overlapped printing by said first and said second print heads, wherein said first print head prints primarily in the first lateral print area, and wherein said second print head prints primarily in said second lateral print area.

5. A multi-head printer according to claim 1, further comprising a bi-directional interface to receive print data and a mode selection command from a host computer.

6. A multi-head printer according to claim 5, further comprising sensing means to sense print head configuration of said printer, and wherein said printer is adapted to provide the sensed print head configuration to said host computer, whereby mode selection may be based on selection of modes available as determined by print head configuration.

7. A multi-head printer according to claim 5, wherein said host computer is adapted to obtain print characteristics of the print data and is further adapted to select a mode from available print modes based on print characteristics of the print data.

8. A multi-head printer according to claim 5, wherein said host computer is adapted to prompt for user selection of a print mode from available print modes determined from said head configuration.

9. A multi-head printer according to claim 1, further comprising sensing means for sensing head configuration, and further comprising control means for automatic selection of a print mode based on the sensed head configuration.

10. A multi-head printer according to claim 1, further comprising detection means for detecting width of a recording medium inserted in said printer, and further comprising control means for automatic selection of a print mode based on the detected width.

11. A multi-head printer according to claim 1, further comprising a fixed registration guide against which recording media of both wide width and standard width are registerable, wherein one end of both the first and second lateral print areas is determined by said registration guide.

12. A multi-head printer according to claim 11, wherein said registration guide defines a recording media feed path, and further comprising a purge station located outside of the recording medium feed path.

13. A multi-head printer according to claim 12, wherein said purge station and said registration guide are positioned at a common end of the printer.

14. A multi-head printer according to claim 12, wherein the second print head is positioned at a side opposite to a side at which said registration guide is positioned.

15. A printing method for a multi-head printer having at least first and second print heads mounted for lateral reciprocal movement across a support surface for a recording medium, the first and second print heads being laterally displaced with respect to each other such that a first lateral print area is printable by both of said first and second print heads and such that a portion of a second and larger lateral print area is printable by said second print head but not by said first print head, said multi-head printer having a standard width print mode for overlapped printing in the first lateral print area by both of said first and second heads as well as a wide width print mode for printing on a wide width print medium in the second lateral print area by at least said second head and not by said first head, said printing method comprising the steps of:

detecting head configuration of the first and second print heads;

determining available print modes based on the detected head configuration;

selecting one of the available print modes; and printing print data in accordance with the selected print mode.

16. A printing method according to claim 15, wherein control means in said multi-head printer automatically selects from the available print modes in said selecting step.

17. A printing method according to claim 16, further comprising the step of detecting width of a recording medium inserted in said printer, and wherein said control means selects the print mode based on the detected width.

18. A printing method according to claim 15, wherein a host computer from which print data is transmitted selects the print mode.

19. A printing method according to claim 18, wherein said host computer selects the print mode based on print characteristics of the print data.

20. A printing method according to claim 18, wherein said host computer prompts a user for selection of the print mode based on a display of available print modes.

21. A print driver, executable in a host computer, so as to select a print mode for a multi-head printer having at least first and second print heads mounted for lateral reciprocal movement across a support surface for a recording medium, the first and second print heads being laterally displaced with respect to each other such that a first lateral print area is printable by both of said first and second print heads and such that a portion of a second and larger lateral print area is printable by said second print head but not by said first print head, said multi-head printer having a standard width print mode for overlapped printing in the first lateral print area by both of said first and second heads as well as a wide width print mode for printing on a wide width print medium in the second lateral print area by at least said second head and not by said first head, said print driver comprising:

determining available print modes based on head configuration of said multi-head printer;

selecting a print mode from among the available print modes; and transmitting print data and the selected print mode to said multi-head printer for printout thereby.

22. A print driver according to claim 21, wherein selection of the print mode is automatic, based on characteristics of the print data.

23. A print driver according to claim 22, wherein characteristics of the print data include color characteristics and width characteristics.

24. A print driver according to claim 21, wherein selection from among the available print modes comprises prompting a user for selection from among a list of available print modes.

25. A computer-readable medium on which is stored code for a print driver executable in a host computer, so as to select a print mode for a multi-head printer having at least first and second print heads mounted for lateral reciprocal movement across a support surface for a recording medium, the first and second print heads being laterally displaced with respect to each other such that a first lateral print area is printable by both of said first and second print heads and such that a portion of a second and larger lateral print area is printable by said second print head but not by said first print head, said multi-head printer having a standard width print mode for overlapped printing in the first lateral print area by both of said first and second heads as well as a wide width print mode for printing on a wide width print medium in the second lateral print area by at least said second head and not by said first head, the code comprising:

code to determine available print modes based on head configuration of said multi-head printer;

code to select a print mode from among the available print modes; and code to transmit print data and the selected print mode to said multi-head printer for printout thereby.

26. A computer-readable medium according to claim 25, wherein selection of the print mode is automatic, based on characteristics of the print data.

27. A computer-readable medium according to claim 26, wherein characteristics of the print data include color characteristics and width characteristics.

28. A computer-readable medium according to claim 25, wherein selection from among the available print modes comprises prompting a user for selection from among a list of available print modes.

29. A printing system comprising:

a multi-head printer having at least first and second print heads mounted for lateral reciprocal movement across a support surface for a recording medium, the first and second print heads being laterally displaced with respect to each other such that a first lateral print area is printable by both of said first and second print heads and such that a portion of a second and larger lateral print area is printable by said second print head but not said first print head, said multi-head printer having a standard width printing mode for overlapped printing in the first lateral print area by both of said first and second print heads, and also having a wide width print mode for printing on a wide width print medium in the second lateral print area by at least said second print head and not by said first print head, said multi-head printer further having a print interface to receive print data and a mode selection; and a host computer including a print driver executable thereon to select a print mode for the multi-head printer by determining available print modes based on head configuration of said multi-head printer, selecting a print mode from among the available print modes, and transmitting print data and the selected print mode to said print interface.

30. A printing system according to claim 29, wherein said heads are laterally displaced by a distance corresponding approximately to one half of the width of standard width printed matter.

31. A printing system according to claim 30, wherein said first and second print heads are displaced by approximately 61 mm.

32. A printing system according to claim 29, further comprising a wide print multi-head mode for overlapped printing by said first and said second print heads, wherein said first print head prints primarily in the first lateral print area, and wherein said second print head prints primarily in said second lateral print area.

33. A printing system according to claim 29, wherein said print interface is comprised by a bi-directional interface.

34. A printing system according to claim 33, further comprising sensing means to sense print head configuration of said printer, and wherein said printer is adapted to provide the sensed print head configuration to said host computer, whereby mode selection may be based on selection of modes available as determined by print head configuration.

35. A printing system according to claim 33, wherein said host computer is adapted to obtain print characteristics of the print data and is further adapted to select a mode from available print modes based on print characteristics of the print data.

36. A printing system according to claim 35, wherein characteristics of the print data include color characteristics and width characteristics.

37. A printing system according to claim 33, wherein said host computer is adapted to prompt for user selection of a print mode from available print modes determined from said head configuration.

38. A printing system according to claim 29, further comprising sensing means for sensing head configuration, and further comprising control means for automatic selection of a print mode based on the sensed head configuration.

39. A printing system according to claim 38, further comprising the step of detecting width of a recording medium inserted in said printer, and wherein said control means selects the print mode based on the detected width.

40. A printing system according to claim 29, wherein the multi-head printer further comprises a fixed registration guide against which recording media of both wide width and standard width are registerable, wherein one end of both the first and second lateral print areas is determined by said registration guide.

41. A printing system according to claim 40, wherein said registration guide defines a recording media feed path, and wherein the multi-head printer further comprises a purge station located outside of the recording medium feed path.

42. A printing system according to claim 41, wherein said purge station and said registration guide are positioned at a common end of the multi-head printer.

43. A printing system according to claim 41, wherein the second print head is positioned at a side opposite to a side at which said registration guide is positioned.

44. A printer for printing data, comprising:

a carriage mounted for lateral movement across a support surface for a recording medium, a first extent of the lateral movement defining a carriage home position; and a printer body defining a manual sheet feed area for accepting the recording medium, said manual sheet feed area including a wide width recording medium extension area disposed opposite the carriage home position.

45. A printer for printing data according to claim 44, further comprising at least first and second print heads mounted to said carriage, said first and second print heads being laterally displaced with respect to each other such that a first lateral print area is printable by both of said first and second print heads and such that a portion of a second lateral print area is printable by said second print head but not by said first print head.

46. A printer for printing data according to claim 45, further comprising:

a standard width print mode for overlapped printing in the first lateral print area by both of said first and second heads; and a wide width print mode for printing by said second print head and not by said first print head.

47. A printer for printing data according to claim 46, wherein said heads are laterally displaced by a distance corresponding approximately to one half of a width of a standard width recording medium.

48. A printer for printing data according to claim 47, wherein said first and second print heads are laterally displaced by approximately 61 mm.

49. A printer for printing data according to claim 46, further comprising a bi-directional interface to receive print data and a mode selection command from a host computer.

50. A printer for printing data according to claim 49, further comprising sensing means to sense a print head configuration of said printer, and wherein a mode selection command is received based on a selection of available modes determined according to print head configuration.

51. A printer for printing data according to claim 49, wherein said host computer is adapted to determine print characteristics of the print data and print modes based on the print characteristics of the print data.

52. A printer for printing data according to claim 50, wherein said host computer is adapted to prompt a user for selection of a print mode from available print modes determined based on said head configuration.

53. A printer for printing data according to claim 46, further comprising sensing means for sensing print head configuration, and control means for automatic selection of a print mode based on the sensed print head configuration.

54. A printer for printing data according to claim 46, further comprising detection means for detecting a width of a recording medium inserted in said printer, and control means for automatic selection of a print mode based on the detected width.

55. A printer for printing data according to claim 46, further comprising a fixed registration guide against which recording media of both wide width and standard width are registerable, wherein one end of both the first and second lateral print areas is determined by said registration guide.

56. A printer for printing data according to claim 55, wherein said registration guide defines a recording media feed path, and further comprising a purge station located outside of the recording medium feed path.

57. A printer for printing data according to claim 56, wherein said purge station and said registration guide are positioned at a common end of the printer.

58. A printer for printing data according to claim 56, wherein the second print head is positioned at a side of the printer opposite to a side of the printer at which said registration guide is positioned.

59. A multi-head printer according to claim 1, wherein both of said first and second print heads print data during said overlapped printing in said first lateral print area.

* * * * *